US009581010B2

(12) United States Patent
Anderson et al.

(10) Patent No.: US 9,581,010 B2
(45) Date of Patent: Feb. 28, 2017

(54) MODULAR INSTRUMENTED SHELL FOR A TOP DRIVE ASSEMBLY AND METHOD OF USING SAME

(71) Applicant: National Oilwell Varco, L.P., Houston, TX (US)

(72) Inventors: Jason Richard Anderson, Round Rock, TX (US); James Edgar Standefer, Round Rock, TX (US); James Brent Welch, Austin, TX (US); James M. Burks, Liberty Hill, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 366 days.

(21) Appl. No.: 14/244,655

(22) Filed: Apr. 3, 2014

(65) Prior Publication Data

US 2015/0285055 A1 Oct. 8, 2015

(51) Int. Cl.

| | |
|---|---|
| ***E21B 47/00*** | (2012.01) |
| ***E21B 33/06*** | (2006.01) |
| ***E21B 47/12*** | (2012.01) |
| ***E21B 3/02*** | (2006.01) |
| ***E21B 19/16*** | (2006.01) |

(52) U.S. Cl.

CPC ..... *E21B 47/00* (2013.01); *E21B 3/02* (2013.01); *E21B 19/166* (2013.01); *E21B 33/06* (2013.01); *E21B 47/122* (2013.01)

(58) Field of Classification Search

CPC ..... E21B 47/00; E21B 33/06; E21B 19/166; E21B 3/02; E21B 47/122

See application file for complete search history.

(56) References Cited

U.S. PATENT DOCUMENTS

| | | | |
|---|---|---|---|
| 5,144,126 | A | 9/1992 | Perry et al. |
| 6,276,450 | B1 | 8/2001 | Seneviratine |

(Continued)

FOREIGN PATENT DOCUMENTS

| | | |
|---|---|---|
| WO | 8910573 | 11/1989 |
| WO | 2008102166 | 8/2008 |

OTHER PUBLICATIONS

PCT International Search Report and Written Opinion dated Sep. 8, 2015 for counterpart PCT/US2015/023732 application, 17 pages.

(Continued)

*Primary Examiner* — Yong-Suk (Philip) Ro

(74) *Attorney, Agent, or Firm* — Conley Rose, P.C.

(57) ABSTRACT

An instrumented shell for sensing drilling parameters of a drilling assembly positionable at a wellsite. The drilling assembly includes a top drive assembly and a downhole tool. The instrumented shell includes a shell body, instruments and an interconnector. The shell body is positionable about the top drive assembly, and has pockets extending therein and a cover positionable about the shell body. The instruments include sensors, and are removably disposable in the pocket and sealable therein with the at least one cover. The interconnector includes a top drive connector removably connectable to the top drive assembly and a shell connector removably connectable to the shell body with a cable therebetween to pass signals therebetween whereby drilling parameters of the downhole tool may be directly collected.

38 Claims, 13 Drawing Sheets

(56) References Cited

U.S. PATENT DOCUMENTS

| | | | | |
|---|---|---|---|---|
| 6,429,787 | B1 | 8/2002 | Pyne | |
| 6,956,791 | B2 | 10/2005 | Dopf et al. | |
| 7,108,081 | B2 | 9/2006 | Boyadjieff | |
| 7,121,295 | B2 | 10/2006 | Seneviratine et al. | |
| 7,287,544 | B2 | 10/2007 | Seneviratine et al. | |
| 7,591,304 | B2 | 9/2009 | Juhasz et al. | |
| 8,631,882 | B1 | 1/2014 | Keast | |
| 2001/0049049 | A1 | 12/2001 | Hensley et al. | |
| 2004/0222023 | A1 | 11/2004 | Haci et al. | |
| 2004/0251048 | A1 | 12/2004 | Kurkoski | |
| 2005/0081918 | A1 | 4/2005 | Seneviratine et al. | |
| 2005/0167157 | A1 | 8/2005 | Boyadjieff | |
| 2006/0191679 | A1 | 8/2006 | Seneviratine et al. | |
| 2006/0219438 | A1 | 10/2006 | Moore et al. | |
| 2008/0202810 | A1 | 8/2008 | Gomez | |
| 2010/0314100 | A1* | 12/2010 | Tepavac | E21B 19/166 166/77.51 |
| 2011/0162891 | A1 | 7/2011 | Camp | |
| 2011/0226485 | A1 | 9/2011 | Seneviratine et al. | |
| 2012/0305102 | A1 | 12/2012 | Kukielka | |

OTHER PUBLICATIONS

Besaisow, A.A., Ng, F.W., "Application of ADAMS (Advanced Drillstring Analysis and Measurement System) and Improved Drilling Performance", IADC/SPE 19998, 1990, 6 pages.

Besaisow, A.A., Jan, Y.M., and Schuh, FJ., "Development of a Surface Drillstring Vibration Measurement System", SPE 14327, Society of Petroleum Engineers, 1995, 14 pages.

Wylie, R., Standefer, J., Anderson, J., and Soukup, I., "Instrumented Internal Blowout Preventer Improves Measurements for Drilling and Equipment Optimization", SPE/IADC 163475, 2013, 14 pages.

* cited by examiner

MODULAR INSTRUMENTED SHELL FOR A TOP DRIVE ASSEMBLY AND METHOD OF USING SAME

BACKGROUND

The disclosure relates generally to techniques for performing wellsite operations. More specifically, the disclosure relates to drilling equipment, such as top drives, internal blowout preventers, and sensors, for performing drilling operations.

Oilfield operations may be performed to locate and gather valuable downhole fluids. Downhole drilling tools are advanced into subterranean formations to form wellbores to reach subsurface reservoirs. The drilling tools include a drill string, a bottomhole assembly, and a drill bit assembled at a surface rig using surface equipment. The surface equipment includes a top drive used to threadedly connect stands of drill pipe together to form the drill string. Fluid from a mud pit is passed through the drill string and out the bit to facilitate drilling.

During wellsite operations, such as drilling, sensing devices may be provided to sense various drilling parameters. For example, drilling tools may be provided with measurement while drilling and logging while drilling tools to measure drilling parameters, such as weight on bit and torque. These sensing devices may be used to collect data for analysis. Examples of drilling devices are provided in application Ser. No. 20110226485, U.S. Pat. Nos. 7,591,304 and 7,108,081, the entire contents of which are hereby incorporated by reference herein.

SUMMARY

In at least one aspect, the disclosure relates to an instrumented shell for sensing drilling parameters of a drilling assembly positionable at a wellsite. The drilling assembly includes a top drive assembly and a downhole tool advancable into a subterranean formation. The instrumented shell includes a shell body positionable about the top drive assembly (the shell body having at least one pocket extending therein and at least one cover positionable about the shell body), at least one instrument comprising at least one sensor (the at least one instrument removably disposable in the at least one pocket and sealable therein with the at least one cover), and an interconnector. The interconnector includes a top drive connector removably connectable to the top drive assembly and a shell connector removably connectable to the shell body with a cable therebetween to pass signals therebetween whereby drilling parameters of the downhole tool may be directly collected.

The instrumented shell body may have a roller groove extending into an exterior surface thereof. The shell body may have a wire path with wires therein, with the wire path extending into an exterior surface of the shell body, and the wires operatively connecting a plurality of the at least one instrument. The instrumented shell may also include a path cover positionable about the shell body to removably enclose the wire path. The instruments may include antennas operatively connectable to a surface unit. Each antenna includes an antenna puck removably disposable in the pockets. The antennas comprise three antennas positionable about the shell body with a 120 degree overlapping beamwidth thereabout.

The cable include a ruggedized interconnect cable and wherein the shell connector and the top drive connector comprise quick release connectors. The instruments may include at least one battery, wireless link, transceiver, additional sensor, transmitter module, radio frequency (RF) splitter, and/or electronics. The instrumented shell may include a seal to electrically isolate the instruments in the pockets. The seal may include an elastomeric material disposable about the cover and/or the pocket.

The shell body may have a hole to receive the top drive assembly therethrough. The instrumented shell may also include a cam carried by the shell body and operatively connectable to the top drive assembly to selectively restrict flow of fluid therethrough. The shell body may have a flange extending therefrom. The instrumented shell may also include a cover seal disposable about the cover to seal the pockets. The instrumented shell may also include a switch.

In another aspect, the disclosure relates to a drilling assembly positionable at a wellsite for drilling a wellbore into a subterranean formation. The drilling assembly includes a top drive assembly, a downhole tool deployable into the subterranean formation by the top drive assembly, and an instrumented shell for sensing drilling parameters of the drilling assembly, the instrumented shell operatively connectable to the top drive assembly. The instrumented shell includes a shell body positionable about the top drive assembly (the shell body having at least one pocket extending therein and at least one cover positionable about the shell body), at least one instrument comprising at least one sensor (the at least one instrument removably disposable in the at least one pocket and sealable therein with the at least one cover), and an interconnector. The interconnector includes a top drive connector removably connectable to the top drive assembly and a shell connector removably connectable to the shell body with a cable therebetween to pass signals therebetween whereby drilling parameters of the downhole tool may be directly collected.

The top drive assembly may also include at least one of a traveling block, a motor, an internal blowout preventer, an elevator, a sub, a pipe handler, and combinations thereof. The internal blowout preventer may include at least one upper internal blowout preventer, at least one lower internal blowout preventer, and combinations thereof. The top drive assembly may include an internal blowout preventer having a valve to selectively restrict fluid flow through the top drive assembly. The top drive assembly may include an internal blowout preventer, with the shell housing positionable about an outer surface of the internal blowout preventer.

The drilling system may also include a surface unit operatively connectable to one of the top drive assembly and/or the at least one sensor to pass signals therebetween. The instrument may include antennas. The drilling system may also include a surface unit operatively connectable to the instruments via the antennas. The antennas may emit overlapping antenna beams, and may be equally spaced about the shell and remaining within line of sight to a surface unit regardless of the movement of the top drive assembly about the wellsite. The downhole tool may include a drill string, a bottom hole assembly, and a drill bit. The downhole tool may include a plurality of wired drill pipe communicatively connectable to the top drive assembly and/or at least one gauge positionable about the top drive system, the at least one gauge comprising a strain gauge.

Finally, in another aspect, the disclosure relates to a method of sensing drilling parameters of a drilling assembly positionable at a wellsite. The drilling assembly includes a top drive assembly and a downhole tool. The method involves operatively connecting an instrumented shell to the top drive assembly. The instrumented shell includes a shell body, at least one instrument including at least one sensor, and an interconnector. The shell body has at least one pocket extending therein. The method involves removably enclosing the instrument in the pocket with a cover, operatively connecting the instruments to the top drive assembly by removably connecting the interconnector to the shell body and the top drive assembly with the interconnector, and directly collecting drilling parameters from the drilling assembly with the at least one sensor.

The operatively connecting may involve involves removably connecting the shell about an internal blowout preventer of the top drive assembly. The method may involve passing signals between the sensor and the top drive via the interconnector, passing signals between the at least one sensor and the surface unit via antennas, drilling the wellbore with the downhole tool, selectively restricting flow through the top drive assembly, drilling a wellbore with the downhole tool, passing signals between the drill string and the top drive assembly, measuring parameters of the drilling assembly with a gauge positionable about the top drive assembly, switching the instruments between an on and an off position, selectively activating flow of the fluid through the top drive, and/or electrically isolating the instruments within the at least one pocket.

BRIEF DESCRIPTION DRAWINGS

So that the above recited features and advantages can be understood in detail, a more particular description, briefly summarized above, may be had by reference to the embodiments thereof that are illustrated in the appended drawings. It is to be noted, however, that the appended drawings illustrate example embodiments and are, therefore, not to be considered limiting of its scope. The figures are not necessarily to scale and certain features and certain views of the figures may be shown exaggerated in scale or in schematic in the interest of clarity and conciseness.

Figure 8A:
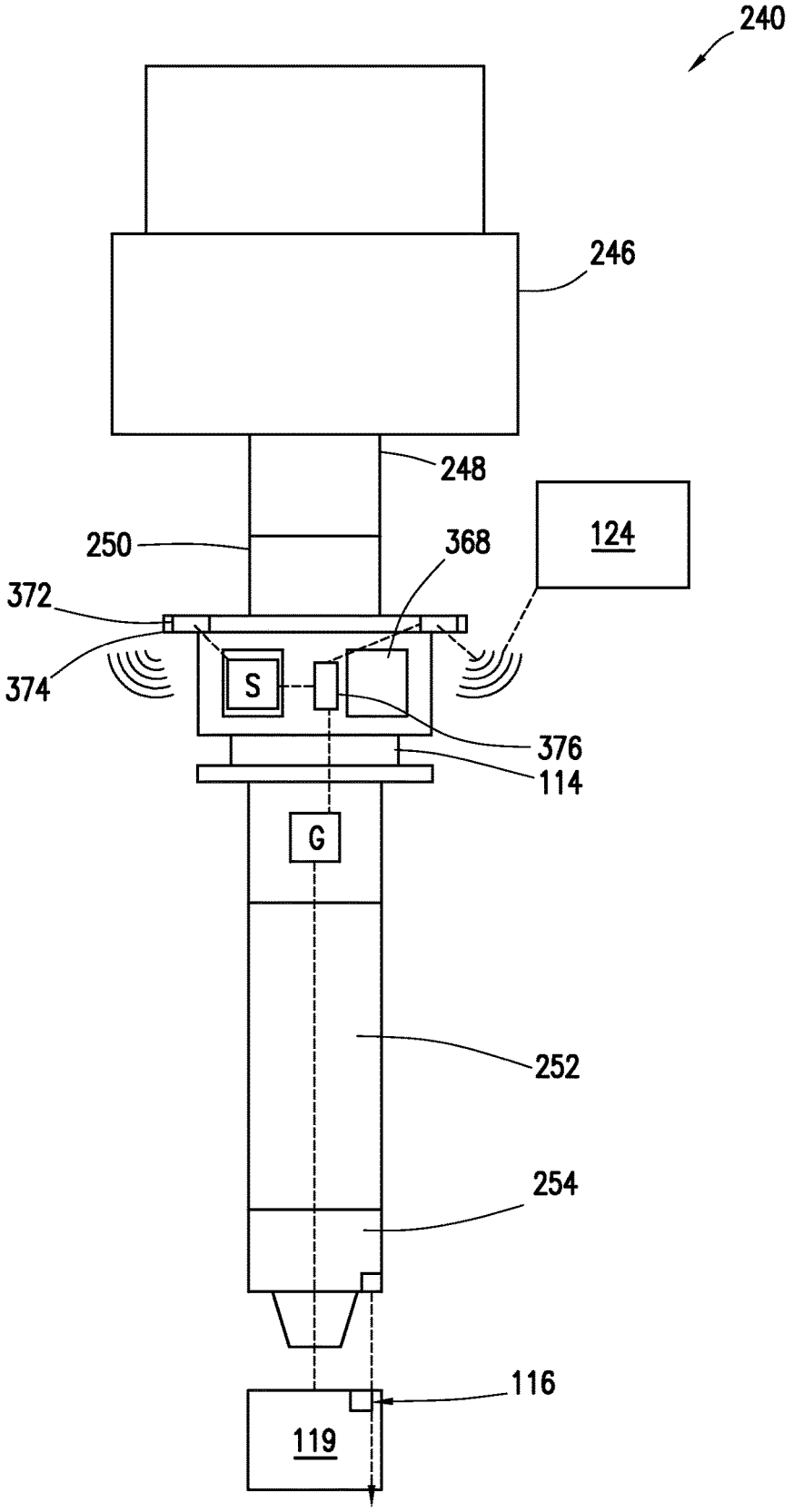
Figure 8B:
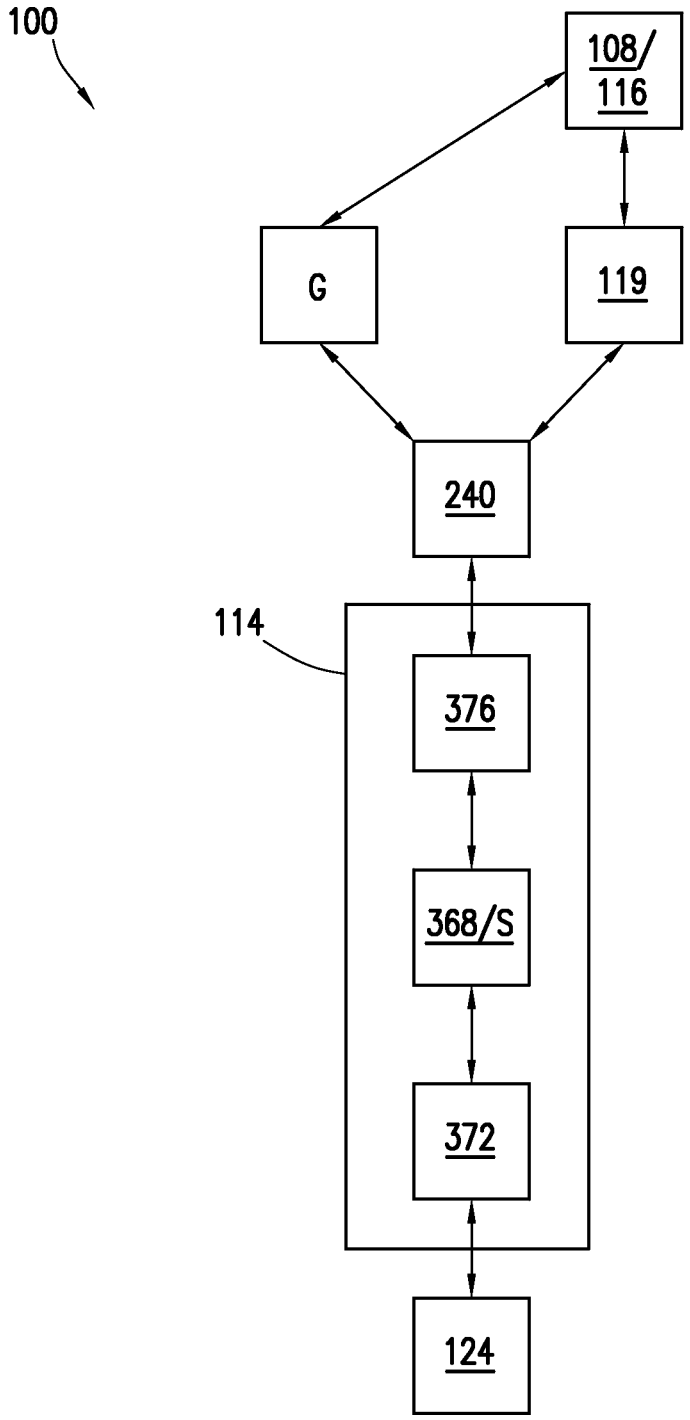

FIGS. 8A and 8B a schematic views depicting operation of the instrumented shell.

Figure 9:
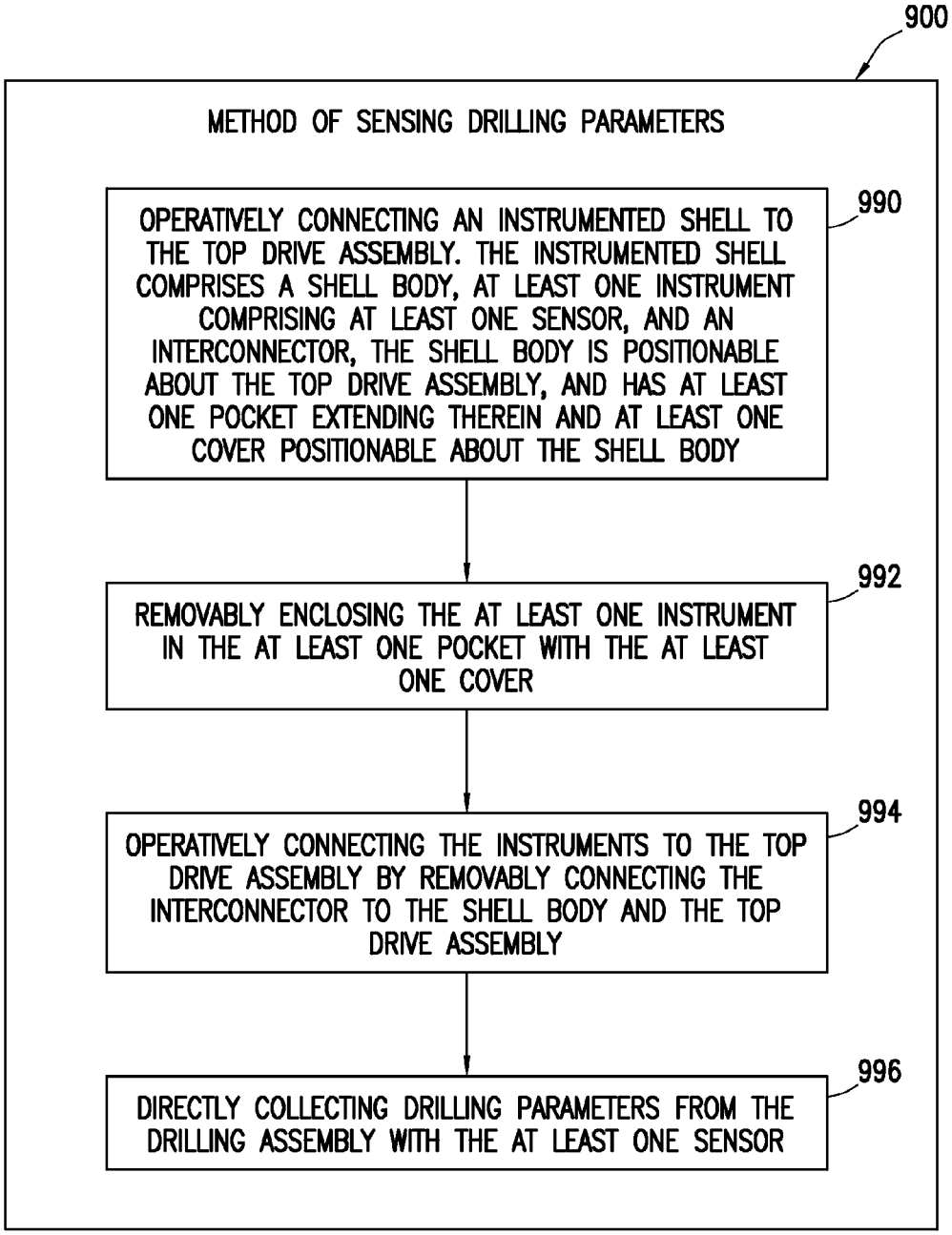

FIG. 9 is a flow chart depicting a method of sensing drilling parameters.

DETAILED DESCRIPTION

The description that follows includes exemplary systems, apparatuses, methods, and instruction sequences that embody techniques of the inventive subject matter. However, it is understood that the described embodiments may be practiced without these specific details.

The disclosure relates to an instrumented shell of a top drive assembly used to sense (measure) drilling parameters, such as strain, tension, compression, torque, bending, acceleration, pressure, temperature, rotational velocity, battery voltage, sensor health, position (e.g., rotational), valve orientation, drill string dynamics, downhole tool dynamics, top drive forces, etc. The instrumented shell may be part of, or coupled to, the top drive assembly, an internal blowout preventer (IBOP), and/or other portions of the drilling assembly.

The instrumented shell may be a modular component that houses instruments, such as sensors, batteries, wiring, wireless links, transceivers, transmitter module, radio frequency (RF) splitter, and/or other electronics, used to sense the drilling parameters. The instrumented shell may include a shell body having pockets to receive and sealingly isolate the instruments therein. The instrumented shell may be positioned at the drill string for direct sensing drilling parameters, and/or a distance from the drill string for indirect sensing. The modular configuration of the instrumented shell may provide, for example, packaging configurations for re-use of components of the drilling assembly and/or the instrumented shell. The modular configuration may also be usable in multiple top drive and/or pipe handler configurations. All and/or part of the instrumented shell may be removable and/or replaceable.

Figure 1:
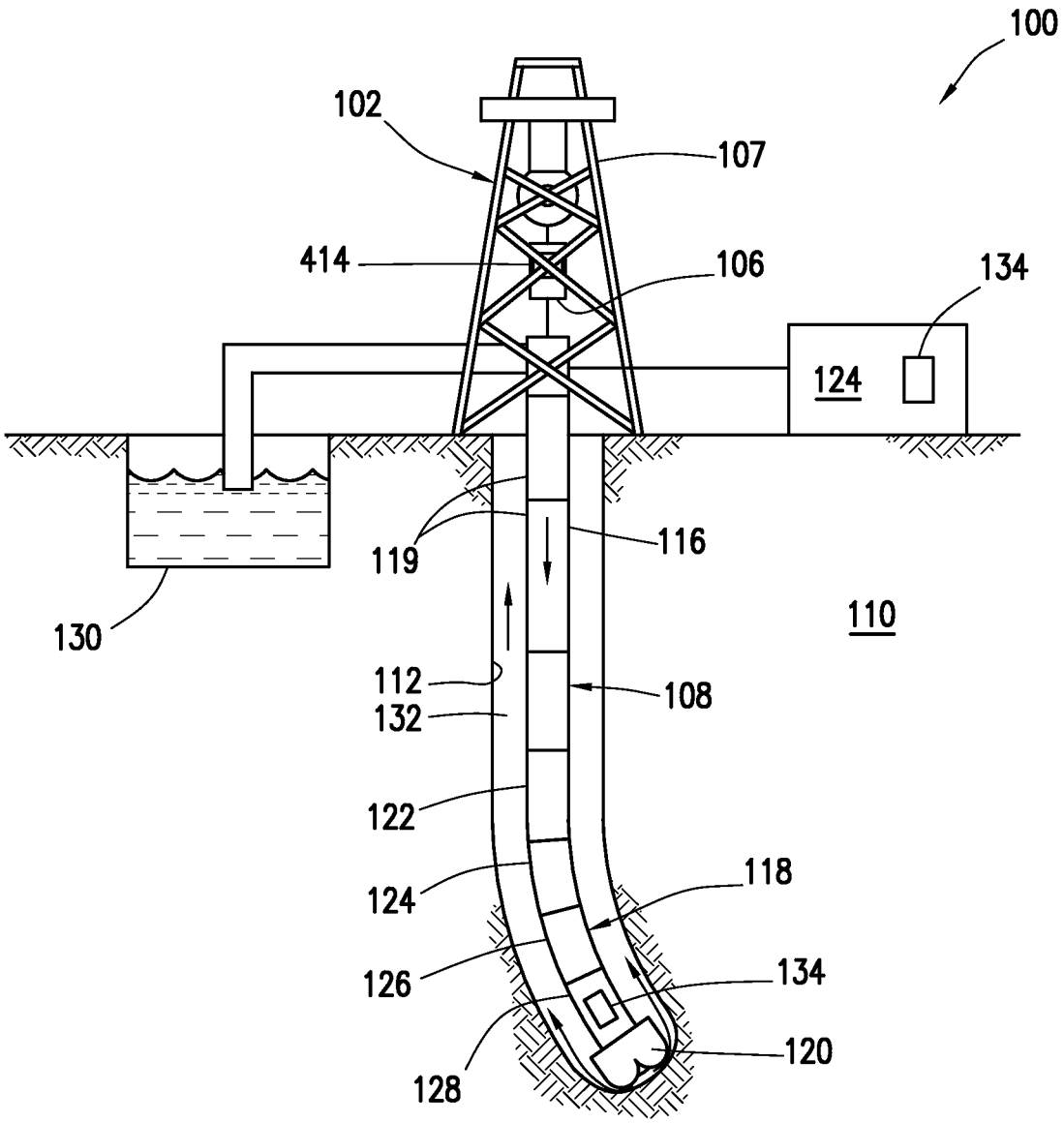
FIG. 1 is a schematic view, partially in cross-section, of a wellsite including a drilling assembly with a top drive assembly and a downhole tool deployable into a subterranean formation.

FIG. 1 shows a wellsite 100 including a drilling assembly 102 for performing various wellbore operations, such as drilling. The wellsite 100 may be on or offshore. The drilling assembly 102 includes a rig 104, a top drive assembly 106, and a downhole tool 108. The downhole tool 108 is deployed by the top drive assembly 106 into the formation 110 to form a wellbore 112.

The top drive assembly 106 may include various drilling equipment, such as a Kelly, rotary table, top drive, elevator, IBOP, etc., for performing drilling operations. Examples of drilling equipment, such as top drive, pipe handlers, elevators, and/or IBOPS, are provided in application Ser. No. 20110226485, U.S. Pat. Nos. 7,591,304 and 7,108,081, previously incorporated by reference herein. The top drive assembly 106 may be operatively connectable to, and/or be included as part of, the drilling assembly 102. An instrumented sub 114 may be positioned about the top drive assembly 106 for measuring drilling parameters at the wellsite 100.

The downhole tool 108 includes a drill string 116, a bottom hole assembly (BHA) 118, and bit 120. The drill string 116 may include stands of tubulars 119, such as drill pipes, tubular joints, connectors, etc., threadedly connectable by the top drive assembly 106 to form the drill string 116 and extend the downhole tool 108 into the subterranean formation 110. The BHA 118 may include various downhole components for performing downhole operations, such as measurement tools 122 (e.g., measurement while drilling tool, logging while drilling tool, etc.), a telemetry device 124, a motor 126, electronics 128, and/or other downhole components.

A mud pit 130 may be provided at the surface for passing mud through top drive assembly 106, the drill string 116, the BHA 118, and out the bit 120 as indicated by the arrows. Cuttings may be returned to the surface through an annulus 132 between the drill string 110 and a wall of the wellbore 112 as also indicated by arrows.

A surface unit 124 may also be provided at the surface to operate the wellsite 100. The surface unit 124 and/or BHA 118 may be provided with a controller 134 for passing signals (e.g., power and/or communication) about the wellsite and/or offsite locations. One or more surface and/or downhole controllers may be provided about the wellsite. The controller may include processors, communicators, databases, computers, and/or other devices capable of communicating with portions of the wellsite, collecting data, sending comments, analyzing data, providing outputs, etc.

Figure 2A:
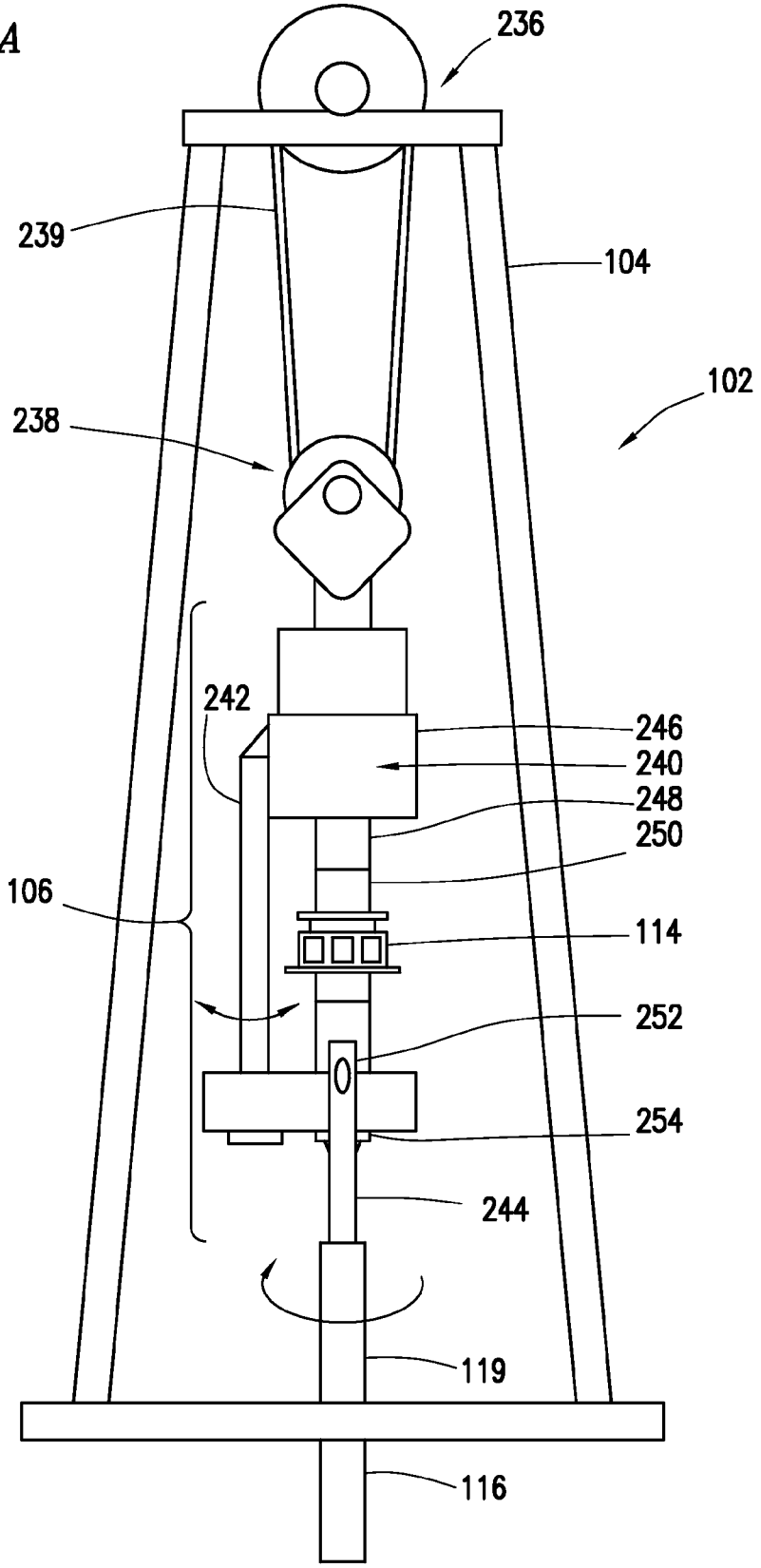
FIGS. 2A and 2B are schematic views depicting the drilling assembly including a top drive assembly with a top drive and an instrumented shell.
Figure 2B:
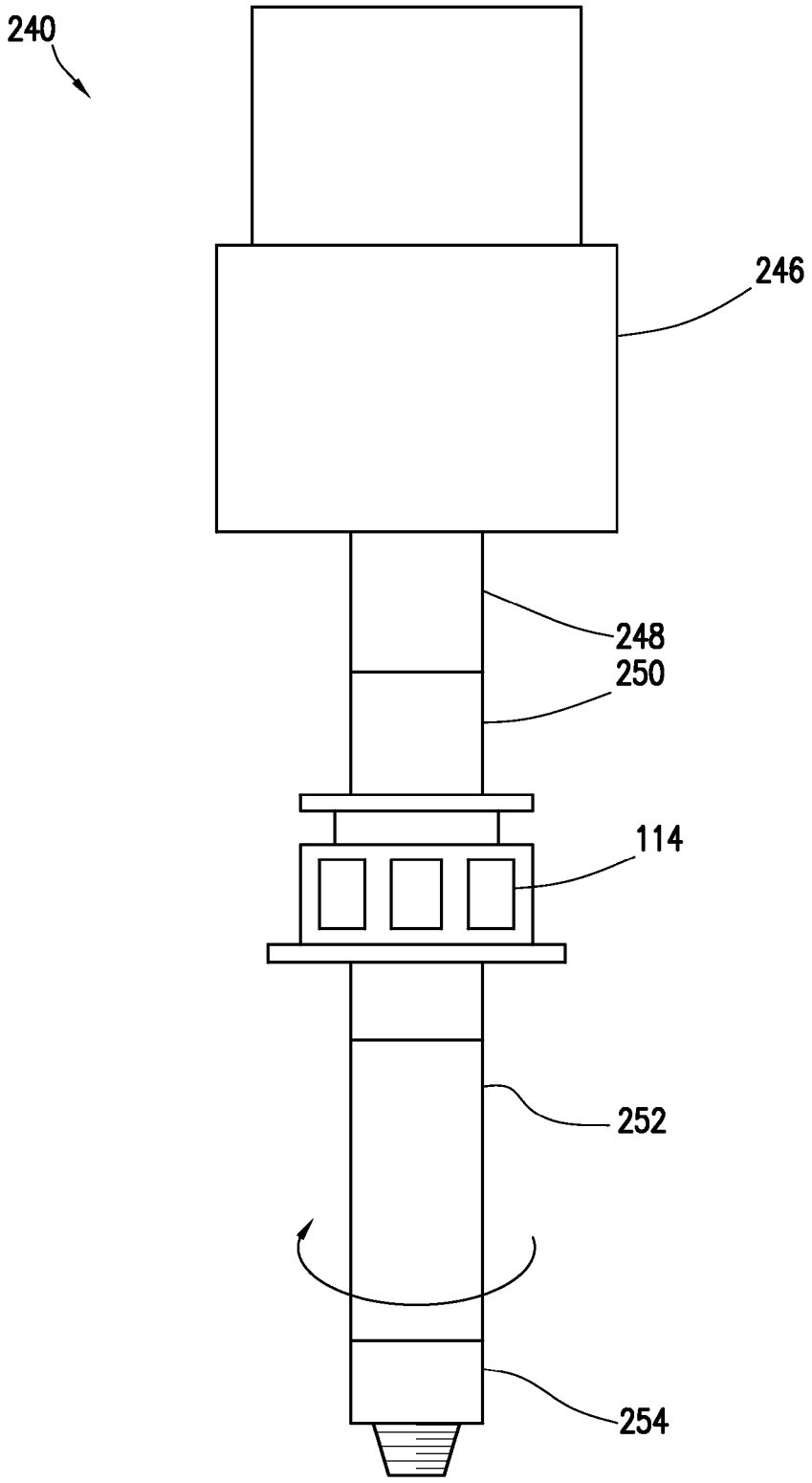

FIGS. 2A and 2B depict schematic portions of the drilling assembly 102. FIG. 2A shows the top drive assembly 106 positioned about the rig 104. FIG. 2B shows the top drive assembly 106 removed from the rig 104. As shown in FIG. 2A, the drilling assembly 102 includes a crowning block 236 movably coupled to a traveling block 238 by a cable 239. The top drive assembly 106 is suspended from the rig 104 by the traveling block 238.

The top drive assembly 106 includes a top drive 240, a pipe handler 242, and an elevator 244. The top drive assembly 108 may be provided with other components, such as swivels, rotary tables, etc. The top drive 240 includes a motor 246, a mainshaft 248, an upper IBOP 250, a lower IBOP 252, and a saver sub 254. The motor 246 drives the mainshaft 248 to rotationally and axially drive portions of the top drive assembly 106, such as the IBOPs 250, 252 and the saver sub 254.

The top drive assembly 106 is connected between the traveling block 238 and an uppermost drill pipe 119 at an uphole end of a series of drill pipe 119 that form the drill string 116. The elevator 244 is suspended from the top drive assembly 106 to support the drill string 116 therebelow. The pipe handler 242 may be used to position additional drill pipe 119 about the uppermost drill pipe 119 for connection to the drill string 116.

Additional drill pipe 119 is threadedly connectable to the uppermost drill pipe 119 of the drill string 116. Each additional stand of drill pipe 119 is threadedly connected to the drill string 116 and the drill string 116 is advanced into the wellbore 112 by axial force and rotational torque provided by the top drive assembly 106. Rotation of the drill pipe 119 by the top drive 240 may be used to rotationally thread additional drill pipe 119 to the drilling string 116 and/or apply torque to the drill string 116 to drive the downhole tool 108.

The instrumented shell 114 may be disposed about portions of the top drive 240, such as the upper IBOP 250, the lower IBOP 252, and/or the saver sub 254, to sense drilling parameters as is described herein. The IBOPs 250, 252 may be internal blowout preventers capable of selectively interrupting flow of fluid from the mud pit and through the top drive assembly 106. The IBOPs 250, 252 may have, for example, a ball valve therein that is activatable to prevent fluid flow through the top drive 240 and into the drill string 116, for example, in a well control situation. Examples of IBOPs are provided in US Patent Application No. 20110226485, previously incorporated by reference herein.

Figure 3:
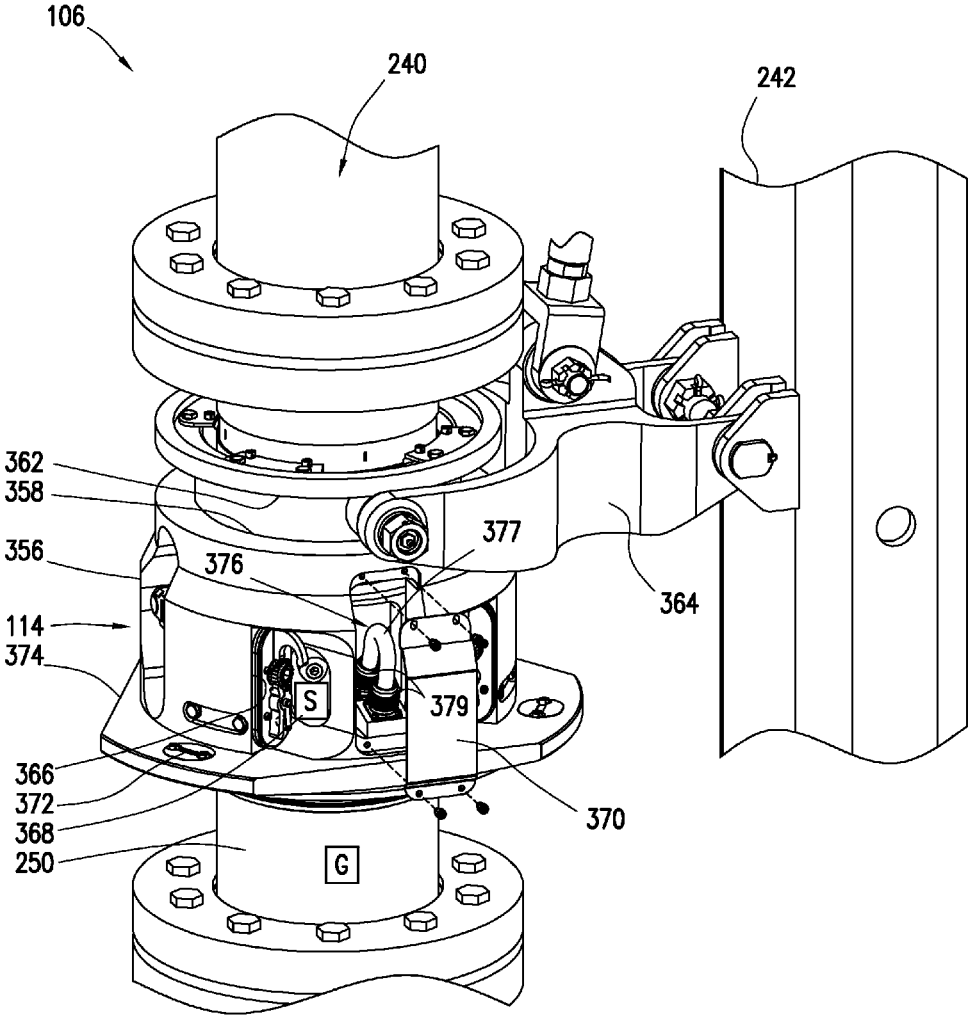
FIG. 3 is a schematic diagram of a portion of the top drive assembly with the instrumented shell thereabout.
Figure 4C:
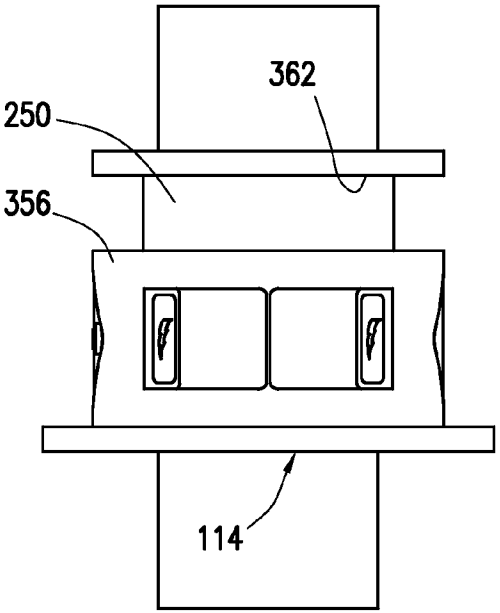
FIGS. 4A-4C are schematic diagrams of a portion of the top drive assembly depicting the instrumented shell in a first position, a second position rotated 90 degrees, and a third position rotated 180 degrees, respectively.
Figure 4B:
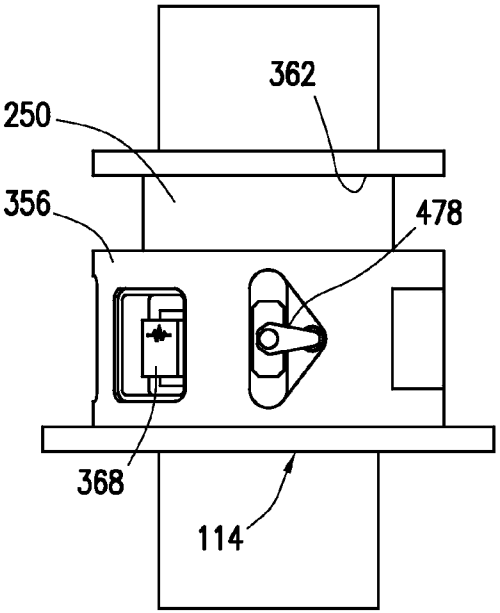
Figure 4A:
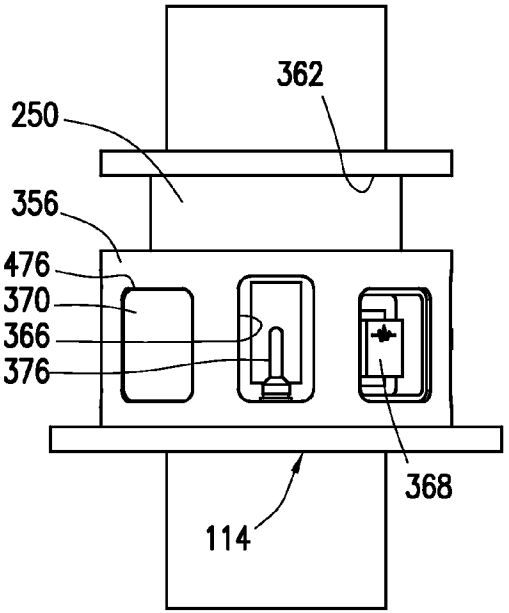

FIG. 3 shows another view of a portion of the top drive assembly 106 with the pipe handler 242 and the top drive 240 with the instrumented shell 114 thereabout. The instrumented shell 114 has a tubular shell body 356 with a hole 358 therethrough disposable about portions of the top drive 240, such as the upper IBOP 250.

The shell body 356 has a groove 362 extending into an exterior surface thereof. The groove 362 and deceivingly engages an arm 364 of the pipe hander 242. The arm 364 may be disposable into a groove 362 to support the instrumented shell 114 and/or top drive 240. The arm 364 is positionable in the groove 362 to selectively move the IBOP 250 axially along and/or rotationally about the top drive assembly 106. This movement may be used, for example, to operate and/or activate a valve of the IBOP 250.

The instrumented shell 114 may be removably positionable about the top drive 240 for modular operation therewith. Portions of the instrumented shell 114 may be modular to permit removal and/or replacement of components, such as threads, valves, wear parts, and/or other portions of the instrumented shell 114 and/or the top drive assembly 106. For example, wear parts, such as valves of the IBOPs may need replacement at intervals of from about 6 to about 12 months while other parts may last longer.

The shape and size of the shell body 356 may be selected to fit about a variety of locations about the top drive 240. The instrumented shell 114 may have a compact configuration that may reduce overall size (e.g., length and/or structure) of the top drive assembly 106, and/or that may be of a size intended to fit available space constraints. Various shell bodies 356 of various configurations may be provided for various top drives and/or applications.

The shell body 356 is provided with pockets 366 to receive instruments 368 therein. A cover 370 may be provided to enclose the instruments 368 in the pockets 366. One or more pockets 366 with one or more covers 370 and one or more instruments 368 may be positioned about the shell body 356. As shown, the pockets 366 extend a distance into an outer surface of the shell body 356.

The instruments 368 may include a variety of electronics, such sensors S (e.g., strain gauges, temperature and/or pressure sensors, etc.), batteries, wireless links, transceivers, transmitter module, radio frequency (RF) splitter, and/or other electronics. One or more instruments 368 may be combined into a package (with or without additional packaging or covering) positioned in the pockets 366 and/or other locations, such as grooves, receptacles, inlets, cavities, etc., capable of receiving electronics therein. One or more sensors S may be located about the instrument shell 114 and/or the drilling assembly 102 to collect data. For example, the sensors S may provide data acquisition during drilling. In another example, the top drive 240 may include set of gauges G (e.g., strain sensors, pressure transducers, etc.)

Each sensor S may be calibrated using a standard to reduce the error of the measurement to a minimum value. Sensor data may be acquired at a rate of up to about 500 Hz. Analog measurements may be converted to a digital value using, for example, an analog to digital converter of about 12 bits. This digital value may then be transmitted over a wireless link to one or more surface units on or offsite (e.g., surface unit 124 of FIG. 1).

The instrumented shell 114 may be positioned about the top drive assembly 106 to obtain the desired data. For example, the instrumented shell 114 may be positioned in direct contact with the downhole tool 104 (e.g., the drillstring) via top drive 240 for direct measurement and/or be coupled to the drilling assembly 102 to the downhole tool 104 to permit indirect measurements thereof.

The instrumented shell 114, position of the pockets 366, and/or instruments 368 may be selected to permit measurement of drilling parameters as needed. One or more of the sensors (e.g., S, G) may be used to collect data and/or take various measurements. Measurements, Such as tension/compression, torsion, bending, rotational velocity, acceleration, pressure, temperature, voltage, may be taken by the sensors before, during, and/or after the drilling process.

Measurements may be taken in real time to provide measurements of the drilling operation as they occur. The measurements may also be used to control torque and over pull situations, and/or to provide fine control of drilling parameters when used with automated systems. Part or all of the instruments 368, such as antennas 372, may be located in other locations about the shell body 356.

As shown, the antennas 372 are positioned in a flange 374 extending radially about the shell body 356. In the example configuration shown, the antennas 372 are depicted as three antenna pucks spaced about the shell body 356 in the flange 374, but any number of a plurality of antennas 372 may be provided.

An interconnector (e.g., cable) 376 is provided to communicatively couple the instrumented shell 114 with the IBOP 250 for passing signals therebetween. The interconnector 376 may electrically connect the instruments 364 to the top drive 240 for receiving signals and/or measurements from the drilling assembly 102 via the top drive 240, and/or passing data measured by the sensor S of the instruments 364. One or more interconnectors 376 may be positioned in one or more of the pockets 366, and/or extend through one or more apertures in the shell body 356. Individual interconnectors 376 may be used to provide the same or different purposes. For example, each interconnector 376 may provide for communication of certain parameters, and/or each interconnector 376 may provide coupling between desired portions of the instrumented shell 114 and/or top drive 240.

The interconnector 376 may be used to removably connect the instrument shell 114 to the IBOP 250 or other portion of the top drive 240. The interconnector may provide for quick change of part or all of the instrumented shell 114, instruments, and/or portions of the top drive 240 (e.g., on or offsite).

The interconnector 376 may be, for example, a ruggedized interconnect cable 377 with connectors 379 at each end thereof. The connectors 379 may be, for example, quick release connectors 379 including a shell connector 379 at one end operatively connectable to the instrument shell 114 and a top drive connector 379 at another end operatively connectable to the top drive 240. The connectors may have, for example, pins that provide quick changing of pinout for use with various instrumented shells 114. The shell connector 379 is operatively (e.g., electrically) connectable to the instruments 368 to pass signals between the instruments 368 and the top drive assembly 240 such that drilling parameters of the downhole tool 108 may be collected by the sensors S.

The interconnector 376 may provide, for example, connection to a variety of devices to provide communication of measured parameters over a wired and/or wireless link. One or more communication links, such as interconnector 376, may be provided to establish communication between the instrument shell 114 and the top drive 240. One or more communication links may be provided between the top drive 240 and/or other devices to establish communication with the surface unit 124 and/or downhole tool 108 (FIG. 1). Measurements may be transmitted, for example, over a wireless (or other) link to an associated wireless receiver system, such as a receiver in the surface unit 124 (FIG. 1).

The instrumented shell 114 may have a modular configuration to permit portions of the instrumented shell 114 and/or top drive 240 to be reusable, while permitting replacement of certain parts as needed. For example, instruments 368 and/or other components with a service life and/or subject to repair/replacement, such as batteries and antennas 372, may be removable and field replaceable. Wear parts, such as the valve of the IBOP, may be replaced, and a shell of the IBOP reused. A ratcheting mechanism may be provided, for example, to facilitate replacement. In cases where instruments are sealed and electrically isolated within the pockets 366, parts may be replaceable using a no drop policy without requiring a safety wire approach for bolt retention.

Figure 5B:
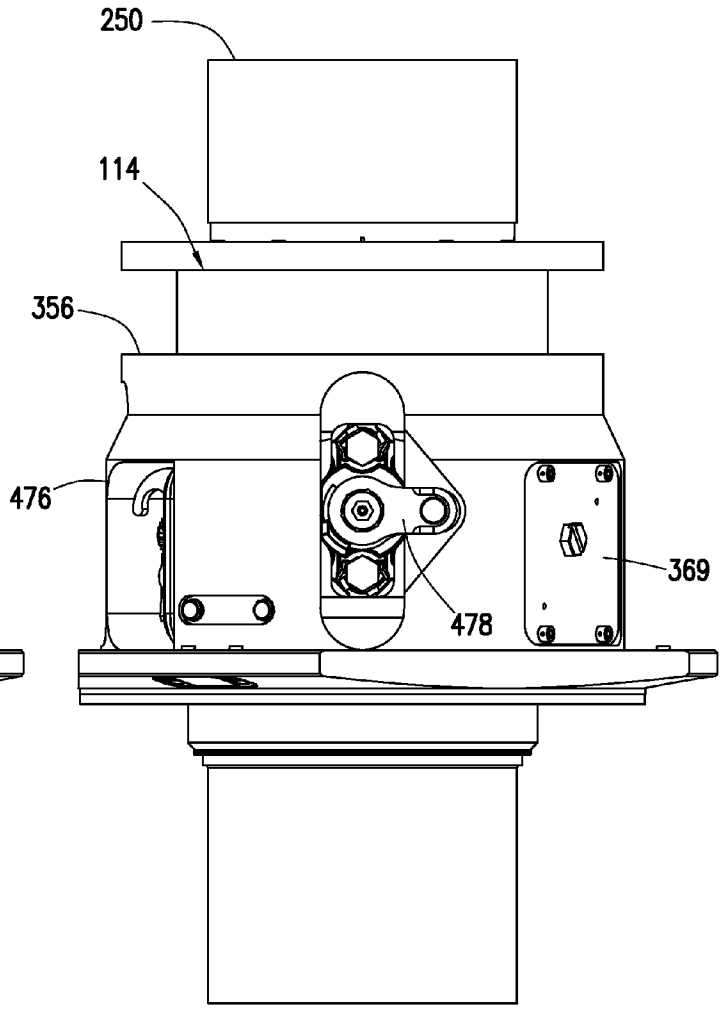
FIGS. 5A-5C are additional schematic diagrams depicting a portion of the top drive assembly with the instrumented shell in a first position, a second position rotated 90 degrees, and a perspective (exploded) position, respectively.
Figure 5A:
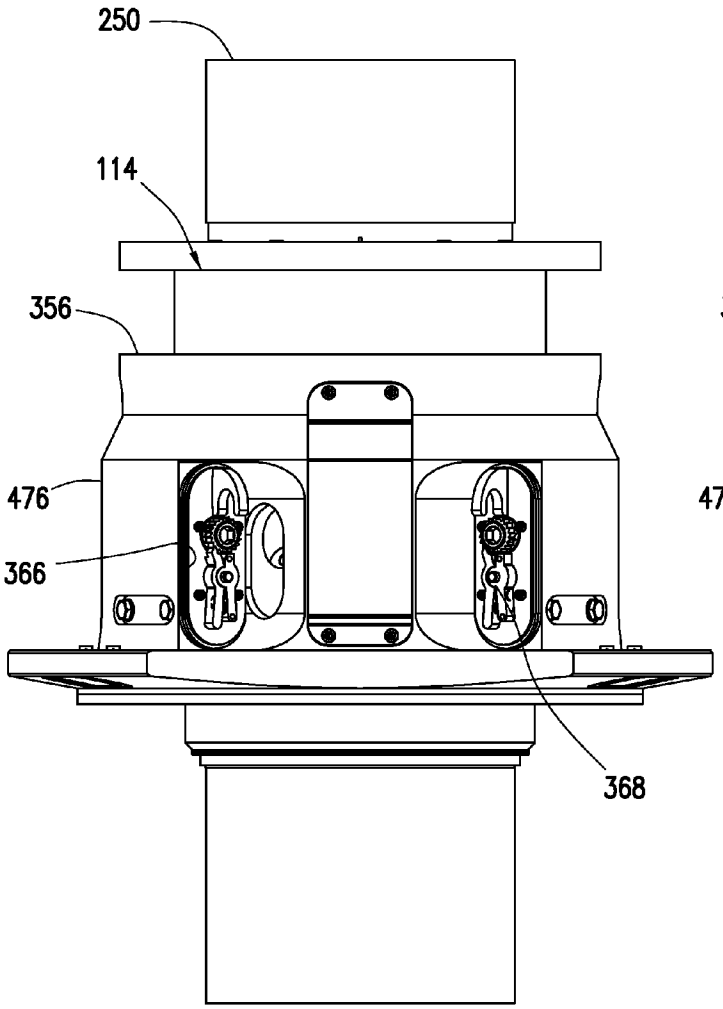
Figure 5C:
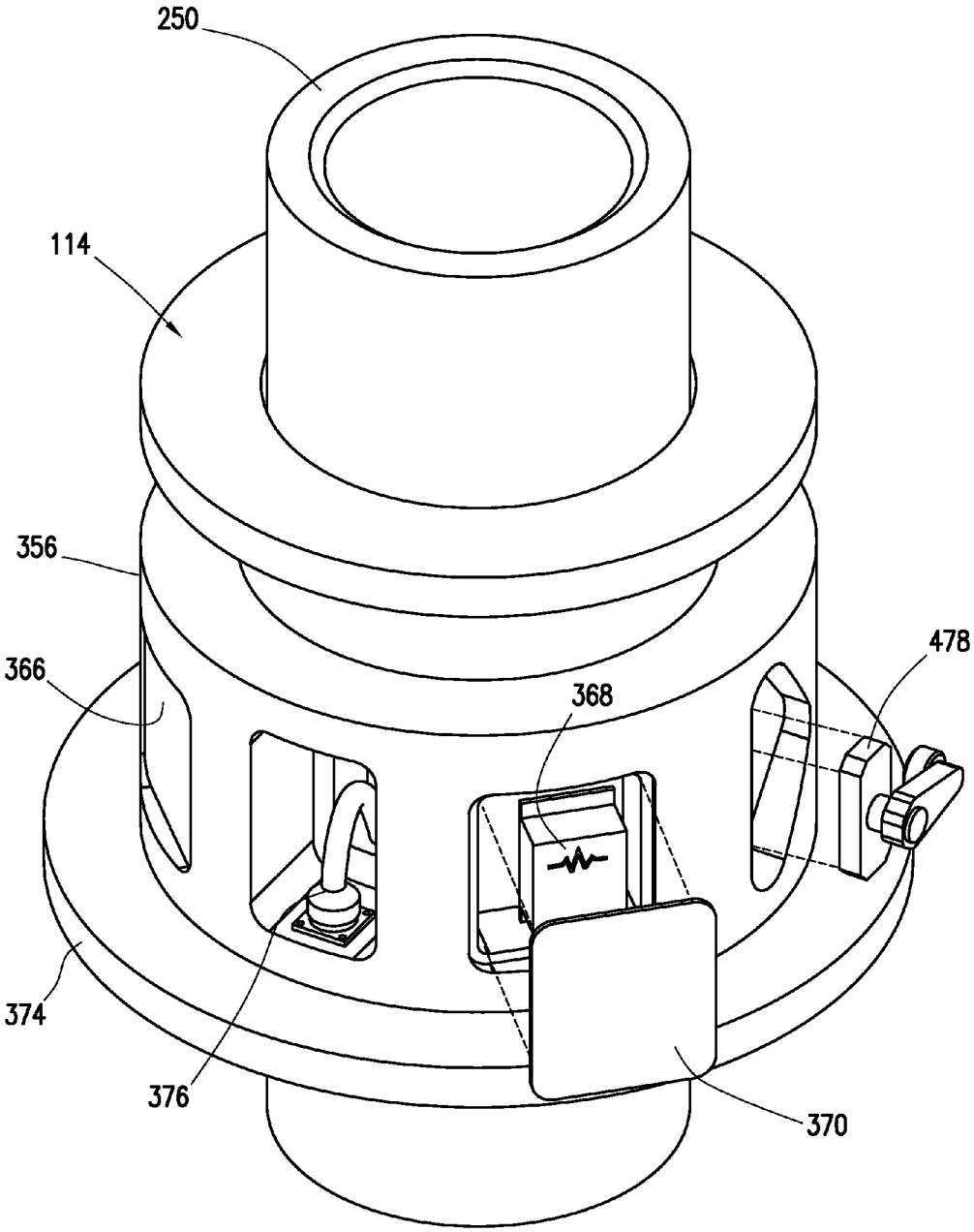
Figure 6A:
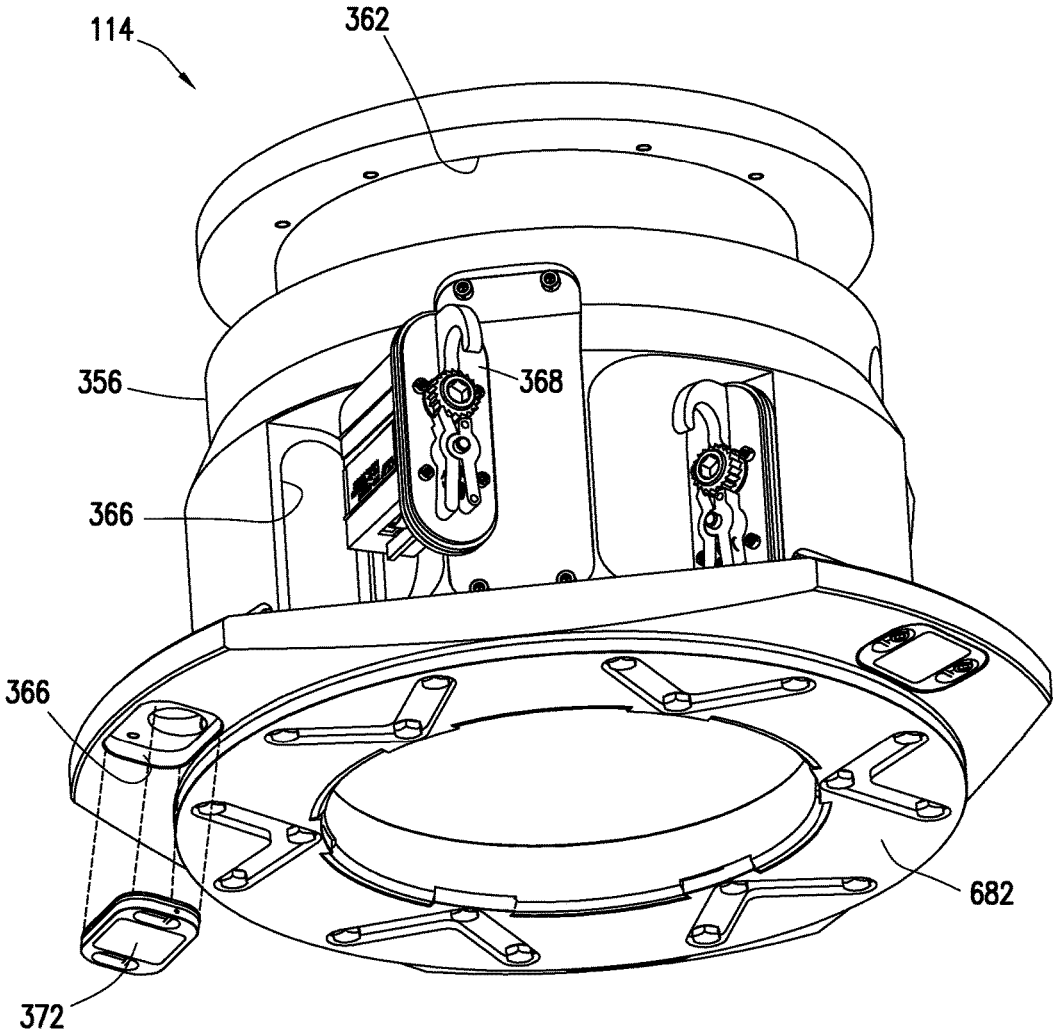
FIGS. 6A and 6B are partially exploded, perspective views of the instrumented shell removed from the top drive assembly.
Figure 6B:
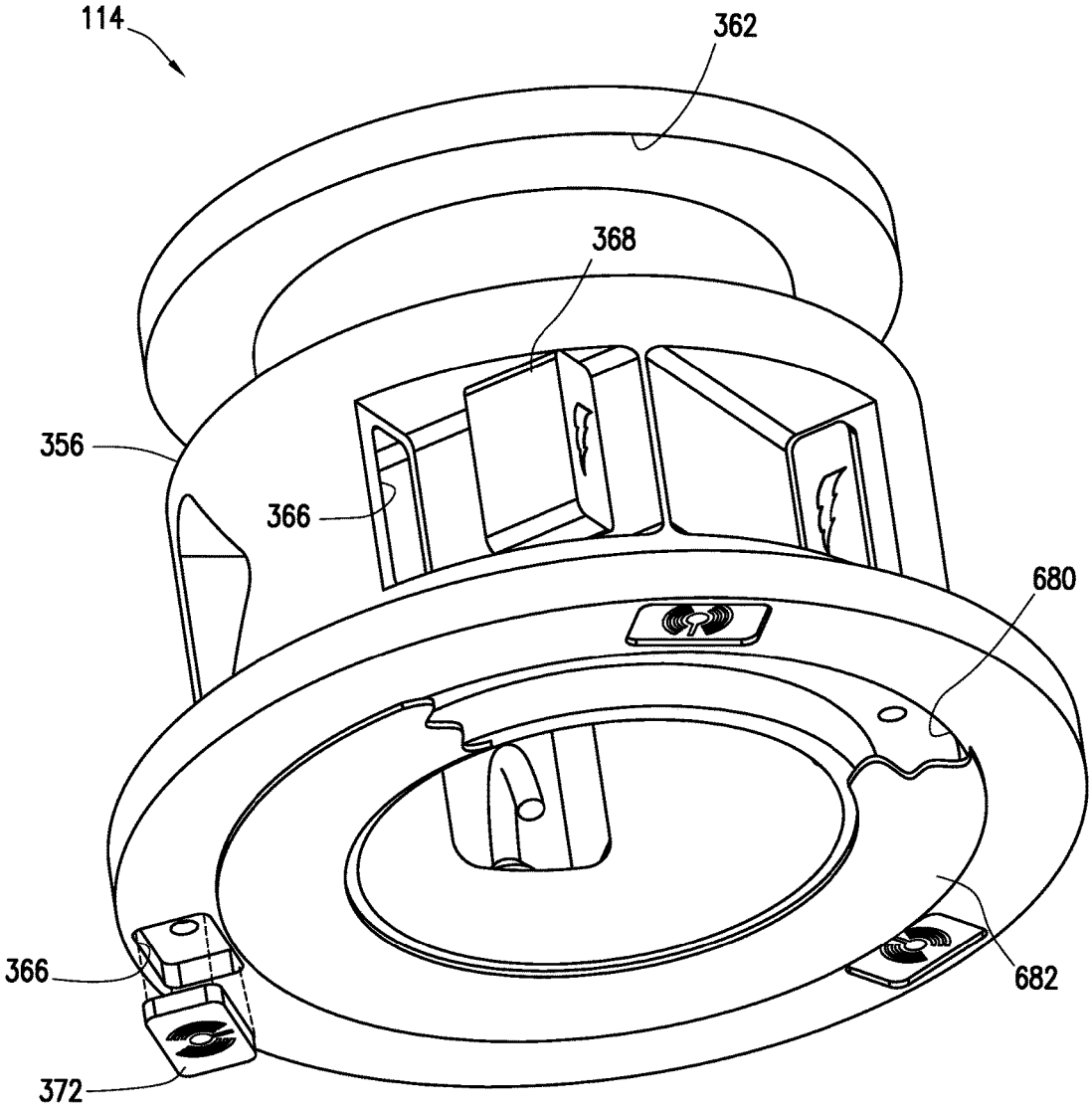

FIGS. 4A-6B show various views of the instrumented shell 114. FIGS. 4A-5C show the instrumented shell 114 disposed about the IBOP 250. FIGS. 6A and 6B show alternate perspective views of the instrumented shell 114. As shown by these views, the shape of these features may vary. These views also show various configurations of the shell body 356, pockets 366, and instruments 368.

For example, the pockets 366 may be of a variety of shapes, such as a rectangular inlet extending into radially into the shell body 356 and shaped to receive a rectangular instrument package as shown in FIG. 5C. In another example, the pockets 366 may have a slanted inlet that leads to a covered pocket below the exterior surface of the shell body 356 to slidingly receive the instruments 368 therein as shown in FIGS. 6A and 6B.

As also shown in these figures, the instrumented shell 114 may be provided with other features. For example, the cover 370 may be provided with a seal 476 to secure the cover 370 about the shell body 356 and fluidly seal the instruments 368 therein. The pockets 366 and cover 370 may define sealed instrument compartments to house and isolate sensitive instruments 368. The seal 476 may be used, for example, to enclose components, such as instruments 368, to prevent loss of service life that may result from load capacity.

The cover 370 may include multiple covers, with one of the covers acting as a power switch. The power switch may be isolated from the instruments 368 by a magnetic interface and sealed barrier. As shown in FIG. 5A, an on/off switch 369 may be provided to turn devices, such as IBOP 250 and/or the instrumented shell 114 on/off. The switch 369 may extend through a cover plate 370 and have a magnet inside rotatable 90 degrees over instruments 360 to selectively activate desired components. The switch 369 may be activatable (e.g., rotated between on and off) by an operator using, for example, ratchet, wrench, coin, etc.

The instrumented shell 114 may be configured to isolate the instruments 368 to prevent potential sparks. When placed in the pockets 366, the instruments are isolated by the covers 370 having seals 476 to provide in an energy limited environment intended to prevent potential for sparking of instruments 368 in pockets 366. The isolated pockets 366 may provide isolation of instruments 368 from a potentially explosive environment during removal of the instrumented shell 114 and/or certain components used therewith. For example, during a battery change, the instruments 368 may be isolated within the pockets to prevent sparking without requiring powering off. The cover seal 476 may also be used about switch 369 to permit activation of the top driver 240 (e.g., IBOP 250) while keeping instruments 368 isolated within the sealed pockets 366.

The instrumented shell 114 may also be provided with a cam 478. The cam 478 extends into one of the pockets 360 or an aperture in the shell body 356, and is operatively couplable to the IBOP 250. The cam 478 may have a handle movable between an open and closed position to selectively activate the IBOP 250. For example, the IBOP 250 (or other top drive component positioned within the instrument shell 114) may have a valve (e.g., ball valve) therein that selectively permits the passage of fluid therethrough. The cam 478 may be used to selectively open and close the valve to control fluid flow through the top drive 240 and into the drill string 116.

As shown in FIGS. 6A and 6B the instrument shell 114 may also have a wire path 680 extending into an exterior surface thereof. As shown, the wire path 680 is an elliptical groove extending into an end surface of the instrument shell 114. A path cover 682 may be positionable about the shell body 356 to removably enclose wires within the wire path 680. The antennas 372 may be positioned in pockets 366 in the flange adjacent the wire path 680. The wire path 680 may electrically couple various instruments 368, such as antennas 372, in the pockets 366 disposed about the shell body 365. The wire path 680 may operatively connect to the shell body 356 for connation to the shell connector 379.

Figure 7A:
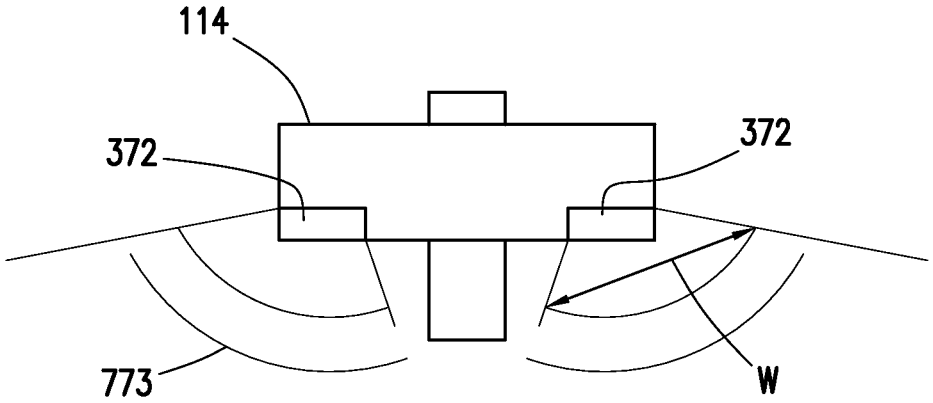
FIGS. 7A and 7B are schematic views of depicting operation of antennas of the instrumented shell.
Figure 7B:
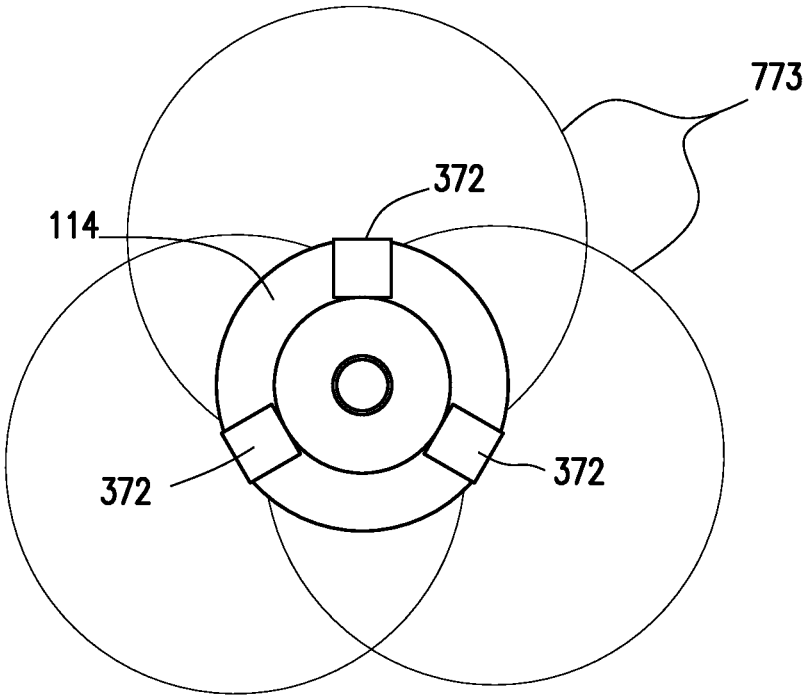

As also shown in FIGS. 6A-7B, the antennas 372 may be positioned about the shell body 356, for example, about a periphery of the flange 374. FIGS. 7A and 7B are schematic diagrams depicting operation of the antennas 372. As shown in these figures, three antennas 372 may be spaced at 120 degree intervals about the instrumented shell 114. The antennas 114 provide an antenna beamwidth W extending therefrom. The antenna beamwidth W overlaps to provide full coverage from the antennas 372.

The antennas 372 may be equally spaced to provide a uniform antenna pattern. The antennas 372 may be positioned to provide an antenna beam 773 extending downhole therefrom. The antennas 372 may be used to create an antenna pattern that ensures line of sight to a base station antenna (e.g., in the surface unit 124 of FIG. 1) regardless of position and/or movement of the instrument shell 114 and/or top drive assembly 106 about the wellsite 100. The antennas 372 may be capable of providing an overlap between the antenna beams 773. The overlap may be used, for example, to create multiple phase centers and to maintain a radio frequency (RF) link.

FIGS. 8A and 8B are schematic diagrams depicting operation of the instrumented shell 114. FIG. 8A shows a schematic view of the top drive assembly 106 with the instrumented shell. FIG. 8B shows a block diagram depicting operation of the instrumented shell with portions of the wellsite, such as the top drive 240, downhole tool 108, and the surface unit 124.

As shown in FIG. 8A, the gauges G on the top drive 240 collect data from the drill string 116 and pass the data to the instrumented sensor S via the interconnector 376. Instruments 368, including sensors S, collect measurements from the gauges G and/or from the IBOP 250. The collected data may be passed via antennas 372 to the surface unit 124. The antennas 372 may be coupled to the sensors S and/or instruments 368 for communication therebetween.

The data may also be passed to the downhole unit 116 by the surface unit 124 and/or the top drive 240 via telemetry connections, such as mud pulse, wired drill pipe, and/or other telemetry at the wellsite. The data may be analyzed and outputs generated by the surface unit. For example, the drill pipes 119 may be provided with wired drill pipe for providing for communication between the downhole tool 108 and various surface components, such as top drive 240 and/or the surface unit 124.

As also demonstrated by FIG. 8A, the instrumented shell 114 may have various configurations, such as an inverted configuration with the antennas 372 positioned in flange 374 at an uphole end thereof. The instrumented shell 114 may be selectively invertable and/or replaceable with various configurations to achieve desired operation.

FIG. 8B is a block diagram depicting communication about the wellsite 100. As shown in this view, the instrumented shell 114 communicates with the top drive 240 (e.g., IBOP 250) via interconnector 376. The top drive 240 communicates with the downhole tool 108 via wired drill pipes 119. Gauges G are provided to gather measurements that may be passed to the instrumented shell 114 via the top drive 240 and interconnector 376. The instrumented shell 114 may communicate with the surface system 124 via antennas 372 to collect and pass data thereto.

FIG. 9 is a flow chart depicting a method 900 of sensing drilling parameters of a drilling assembly positionable at a wellsite. The drilling assembly comprises a top drive assembly and a downhole tool. The method 900 involves 990—operatively connecting an instrumented shell to the top drive assembly. The instrumented shell comprises a shell body, at least one instrument comprising at least one sensor, and an interconnector. The shell body is positionable about the top drive assembly, and has at least one pocket extending therein and at least one cover positionable about the shell body.

The method 900 also involves 992—removably enclosing the at least one instrument in the at least one pocket with the at least one cover, 994—operatively connecting the instruments to the top drive assembly by removably connecting the interconnector to the shell body and the top drive assembly, and 996—directly collecting drilling parameters from the drilling assembly with the at least one sensor.

The method may also involve passing signals between the at least one sensor and the top drive via the interconnector, passing signals between the at least one sensor and the surface unit via antennas, drilling the wellbore with the downhole tool, and/or selectively restricting flow through the top drive assembly. The methods may be performed in any order, and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the subject matter may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more instrumented shells, instruments, pockets, covers, and/or cables of various shapes may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An instrumented shell for sensing drilling parameters of a drilling assembly positionable at a wellsite, the drilling assembly comprising a top drive assembly and a downhole tool advancable into a subterranean formation, the instrumented shell comprising:

a shell body removably connected to the top drive assembly, the shell body having at least one pocket extending radially inward from a radially outer surface of the shell body and at least one cover configured to cover the at least one pocket;

at least one instrument comprising at least one sensor, the at least one instrument removably disposable in the at least one pocket and sealable within the at least one pocket with the at least one cover; and an interconnector comprising a top drive connector removably connectable to the top drive assembly and a shell connector removably connectable to the shell body with a cable between the top drive connector and the shell connector to pass signals between the top drive assembly and the shell body.

2. The instrumented shell of claim 1, wherein the shell body has a roller groove extending into an exterior surface of the shell body.

3. The instrumented shell of claim 1, wherein the shell body has a wire path with wires, the wire path extending into an exterior surface of the shell body, the wires operatively connecting a plurality of the at least one instrument.

4. The instrumented shell of claim 3, further comprising a path cover connected to the shell body to removably enclose the wire path.

5. The instrumented shell of claim 1, wherein the at least one instrument comprises antennas operatively connectable to a surface unit.

6. The instrumented shell of claim 5, wherein each of the antennas comprises an antenna puck removably disposable in the at least one pocket.

7. The instrumented shell of claim 5, wherein each of the antennas comprise three antennas connected to the shell body with a 120 degree overlapping beamwidth.

8. The instrumented shell of claim 1, wherein the cable comprises a ruggedized interconnect cable and wherein the shell connector and the top drive connector comprise quick release connectors.

9. The instrumented shell of claim 1, wherein the at least one instrument comprises at least one of a battery, wireless link, transceiver, additional sensor, transmitter module, and radio frequency (RF) splitter.

10. The instrumented shell of claim 1, further comprising a seal to electrically isolate the at least one instrument in the at least one pocket, the seal comprising an elastomeric material disposable on the at least one cover.

11. The instrumented shell of claim 1, wherein the shell body has a hole to receive the top drive assembly.

12. The instrumented shell of claim 1, further comprises a cam carried by the shell body and operatively connectable to the top drive assembly to selectively restrict flow of fluid.

13. The instrumented shell of claim 1, wherein the shell body has a flange extending from the shell body.

14. The instrumented shell of claim 1, further comprising a cover seal disposable on the cover to seal the at least one pocket.

15. The instrumented shell of claim 1, further comprising a switch.

16. A drilling assembly positionable at a wellsite for drilling a wellbore into a subterranean formation, the drilling assembly comprising:

a top drive assembly;

a downhole tool deployable into the subterranean formation by the top drive assembly;

an instrumented shell for sensing drilling parameters of the drilling assembly, the instrumented shell operatively connectable to the top drive assembly, the instrumented shell comprising:

a shell body removably connected to the top drive assembly, the shell body having at least one pocket extending radially inward from a radially outer surface of the shell body and at least one cover configured to cover the at least one pocket;

at least one instrument comprising at least one sensor, the at least one instrument removably disposable in the at least one pocket and sealable within the at least one pocket with the at least one cover; and an interconnector comprising a top drive connector removably connectable to the top drive assembly and a shell connector removably connectable to the shell body with a cable between the top drive connector and the shell connector to pass signals between the top drive assembly and the shell body.

17. The drilling system of claim 16, wherein the top drive assembly further comprises at least one of a traveling block, a motor, an internal blowout preventer, an elevator, a sub, and a pipe handler.

18. The drilling system of claim 17, wherein the internal blowout preventer comprises at least one upper internal blowout preventer and at least one lower internal blowout preventer.

19. The drilling system of claim 16, wherein the top drive assembly comprises an internal blowout preventer having a valve to selectively restrict fluid flow through the top drive assembly.

20. The drilling system of claim 16, wherein the top drive assembly comprises an internal blowout preventer, the shell housing removably connected to an outer surface of the internal blowout preventer.

21. The drilling system of claim 16, further comprising a surface unit operatively connectable to the top drive assembly and the at least one sensor to pass signals between the top drive assembly and the at least one sensor.

22. The drilling system of claim 16, wherein the at least one instrument comprises antennas, the drilling system further comprising a surface unit operatively connectable to the at least one instrument via the antennas.

23. The drilling system of claim 22, wherein the antennas emit overlapping antenna beams, the antennas being equally spaced on the shell and remaining within line of sight to a surface unit regardless of the movement of the top drive assembly.

24. The drilling system of claim 16, wherein the downhole tool comprises a drill string, a bottom hole assembly, and a drill bit.

25. The drilling system of claim 16, wherein the downhole tool comprises a plurality of wired drill pipe communicatively connectable to the top drive assembly.

26. The drilling system of claim 16, further comprising at least one gauge connected to the top drive system, the at least one gauge comprising a strain gauge.

27. A method of sensing drilling parameters of a drilling assembly positionable at a wellsite, the drilling assembly comprising a top drive assembly and a downhole tool, the method comprising:

operatively connecting an instrumented shell to the top drive assembly, the instrumented shell comprising a shell body, at least one instrument comprising at least one sensor, and an interconnector, the shell body having at least one pocket extending radially inward from a radially outer surface of the shell body;

removably enclosing the at least one instrument in the at least one pocket with at least one cover;

operatively connecting the instruments to the top drive assembly by removably connecting the interconnector to the shell body and the top drive assembly with the interconnector; and directly collecting drilling parameters from the drilling assembly with the at least one sensor.

28. The method of claim 27, further comprising passing signals between the at least one sensor and the top drive via the interconnector.

29. The method of claim 27, wherein the operatively connecting comprises removably connecting the shell to an internal blowout preventer of the top drive assembly.

30. The method of claim 27, further comprising passing signals between the at least one sensor and the surface unit via antennas.

31. The method of claim 27, further comprising drilling the wellbore with the downhole tool.

32. The method of claim 27, further comprising selectively restricting flow through the top drive assembly.

33. The method of claim 27, further comprising drilling a wellbore with the downhole tool.

34. The method of claim 27, further comprising passing signals between the drill string and the top drive assembly.

35. The method of claim 27, further comprising measuring parameters of the drilling assembly with a gauge connected to the top drive assembly.

36. The method of claim 27, further comprising switching the instruments between an on and an off position.

37. The method of claim 27, further comprising selectively activating flow of the fluid through the top drive.

38. The method of claim 27, further comprising electrically isolating the instruments within the at least one pocket.

* * * * *